US007422491B2

(12) United States Patent
Gherardini

(10) Patent No.: US 7,422,491 B2
(45) Date of Patent: Sep. 9, 2008

(54) BUSSING CONNECTOR

(75) Inventor: Stephen D. Gherardini, Harrisburg, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/550,828

(22) Filed: Oct. 19, 2006

(65) Prior Publication Data

US 2008/0096439 A1 Apr. 24, 2008

(51) Int. Cl.
*H01R 9/22* (2006.01)

(52) U.S. Cl. ..... 439/721; 439/212

(58) Field of Classification Search ..... 439/721, 439/212, 352
See application file for complete search history.

(56) References Cited

U.S. PATENT DOCUMENTS

| | | | | | |
|---|---|---|---|---|---|
| 2,820,211 | A | * | 1/1958 | Batcheller | 439/723 |
| 2,965,872 | A | * | 12/1960 | Linn | 439/652 |
| 3,087,137 | A | * | 4/1963 | Linn | 439/721 |
| 3,670,295 | A | * | 6/1972 | Ege et al. | 439/709 |
| 4,054,354 | A | * | 10/1977 | Unger | 439/724 |
| 4,295,181 | A | * | 10/1981 | Chang et al. | 361/684 |
| 5,902,156 | A | * | 5/1999 | Geebelen et al. | 439/714 |
| 6,109,973 | A | * | 8/2000 | Gronowicz et al. | 439/620.21 |
| 2004/0092168 | A1 | | 5/2004 | Vadasz et al. | |

FOREIGN PATENT DOCUMENTS

| | | |
|---|---|---|
| DE | 15 15 370 | 1/1972 |
| DE | 200 19 485 | 3/2001 |
| DE | 203 11 424 | 1/2005 |
| GB | 2 337 369 | 11/1999 |

OTHER PUBLICATIONS

Faston Terminals, (Insulated and Uninsulated) Catalog 82004, Revised Jun. 2004, pp. 3-5; p. 21.
International Search Report; PCT/US2007/021553, dated Apr. 24, 2008.

* cited by examiner

*Primary Examiner*—Renee S Luebke
*Assistant Examiner*—Vanessa Girardi

(57) ABSTRACT

A low-profile electrical connector having a connector body with a bussing interconnection. The bussing interconnection includes a first receptacle and a second receptacle. The first receptacle is in electrical communication with the second receptacle. The connector body also includes an alignment mechanism configured to align and retain a corresponding plug. At least one of the first receptacle or the second receptacle includes a receptacle body having a plurality of arms configured to apply a contact force in the direction of an opposing plate.

11 Claims, 4 Drawing Sheets

BUSSING CONNECTOR

FIELD OF THE INVENTION

The present invention relates to bussing connectors used for interconnecting a plurality of electrical devices. In particular, the present invention is directed to interconnecting power contacts for a plurality of electrical circuits.

BACKGROUND OF THE INVENTION

There is currently an effort to utilize electrical circuitry in building structural components and other products in order to generate electricity or provide additional functionality to the components or products.

Circuits utilized for building products or other applications requiring a series of individual circuits to be electrically linked together suffer from the drawback that connections between these circuits typically require wiring and soldering. Individual wiring and/or soldering of the connections between individual circuits increases the amount of time required for installation and does not easily permit the replacement of individual circuits. In addition, wiring or electronic components are undesirably visible or are obstructed assembly building components themselves. Wiring having reduced thicknesses has the drawback that they are generally fragile and susceptible to damage and/or loss of effectiveness when exposed to conditions typical for building components. Furthermore, wiring having reduced thicknesses typically do not have the ability to conduct the currents necessary for some building product circuit components.

What is needed is a connector that allows the connection of individual circuits in a serial or parallel relationship, which provides excellent electrical contact, has a reduced thickness to reduce visibility and/or building component obstruction and allows easy connection and/or disconnection of the circuits to decrease the time and complexity required to install, replace and/or repair individual circuits.

SUMMARY OF THE INVENTION

An embodiment of the present invention includes a low-profile electrical connector having a connector body with a bussing interconnection. The bussing interconnection includes a first receptacle and a second receptacle. The first receptacle is in electrical communication with the second receptacle. The connector body also includes an alignment mechanism configured to align and retain a corresponding plug. At least one of the first receptacle or the second receptacle includes a receptacle body having a plurality of arms configured to apply a contact force in the direction of an opposing plate.

Another embodiment of the present invention includes a plurality of low-profile electrical connectors each having a connector body with a bussing interconnection. The bussing interconnection includes a first receptacle and a second receptacle. The first receptacle is in electrical communication with the second receptacle. The connector body also includes an alignment mechanism configured to align and/or retain a corresponding plug. At least one of the first receptacle or the second receptacle includes a receptacle body having a plurality of arms configured to apply a contact force in the direction of an opposing plate. The system further includes a first receptacle of a first connector body in contact with a second receptacle of a second connector body. The second receptacle includes a second receptacle body having a tabular blade configured for insertion into the first receptacle body to receive the contact force to provide electrical contact and retention of the second receptacle body in position.

An advantage of an embodiment of the present invention is that circuits associated with building components may be interconnected with few or no solder or wiring connections.

Another advantage of an embodiment of the present invention is that the connectors have a low-profile, wherein the thickness of the connectors does not obstruct adjacent building products or circuits related thereto.

Still another advantage of an embodiment of the present invention is that circuits may be connected together from locations that are remote from one another or are arranged in a plurality of spatially placed circuits.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers are used throughout the drawings to refer to the same or like parts.

DETAILED DESCRIPTION OF THE INVENTION

Figure 1:
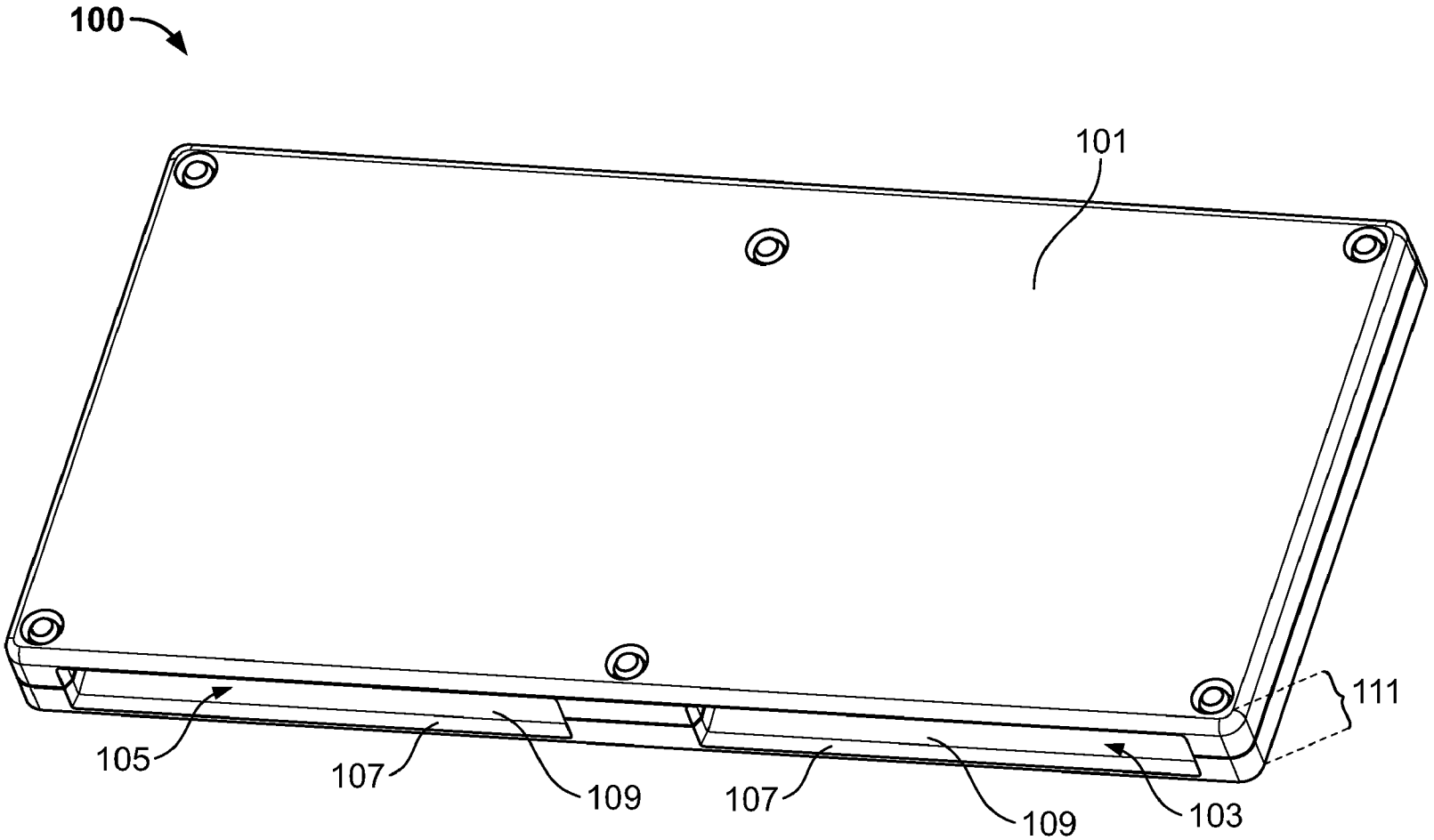
FIG. 1 shows a perspective view of a connector according to the present invention.

FIG. 1 shows an electrical connector 100 according to an embodiment of the present invention. The electrical connector 100 includes a connector body 101, a first alignment slot 103 and a second alignment slot 105. The first and second alignment slots 103 and 105 each include a tapered surface 107, which provide alignment of corresponding plugs (not shown in FIG. 1), wherein the tapered surface 107 engages a surface of a corresponding plug and aligns the plug during engagement (e.g., insertion). The first and second alignment slots 103 and 105 further include an alignment surface 109 that further engage and/or align corresponding plugs during positioning. Alignment surface 109 includes the circumferential inner surface of first and second alignment slots 103 and 105 configured to engage and/or align corresponding plugs during positioning. In one embodiment, plugs positioned within first and/or second alignment slots 103 and 105 may include a clearance along the periphery of the plug. In another embodiment, alignment surface 109 may frictionally engage the corresponding plug and provide resistance to relative movement between the connector body 101 and the plug. In still another embodiment, alignment surface 109 may include features or retention devices that provide additional aligning and/or retaining functionality. While connector 100 of FIG. 1 is shown to include alignment slots 103 and 105, aligning and/or retention devices may be utilized and may include, but is not limited to latches, ribs, threads, quick connection arrangements, locking surface or any other retention arrangement that allows alignment and retention of plugs for connection to connector 100. In one embodiment of the invention, first alignment slot 103 is configured to receive a plug associated with an electrical circuit 301 (see e.g., FIG. 3), while the second alignment slot 105 is configured to receive a plug associated with a spatially positioned second electrical circuit 303 (see e.g., FIG. 3). While first alignment slot 103 and second alignment slot 105 are shown to include the same arrangement of alignment device, the slots 103 and 105 may be the same or different. Further, the geometries of slots 103 and 105 may be any geometry that aligns and/or retains corresponding plugs.

Figure 3:
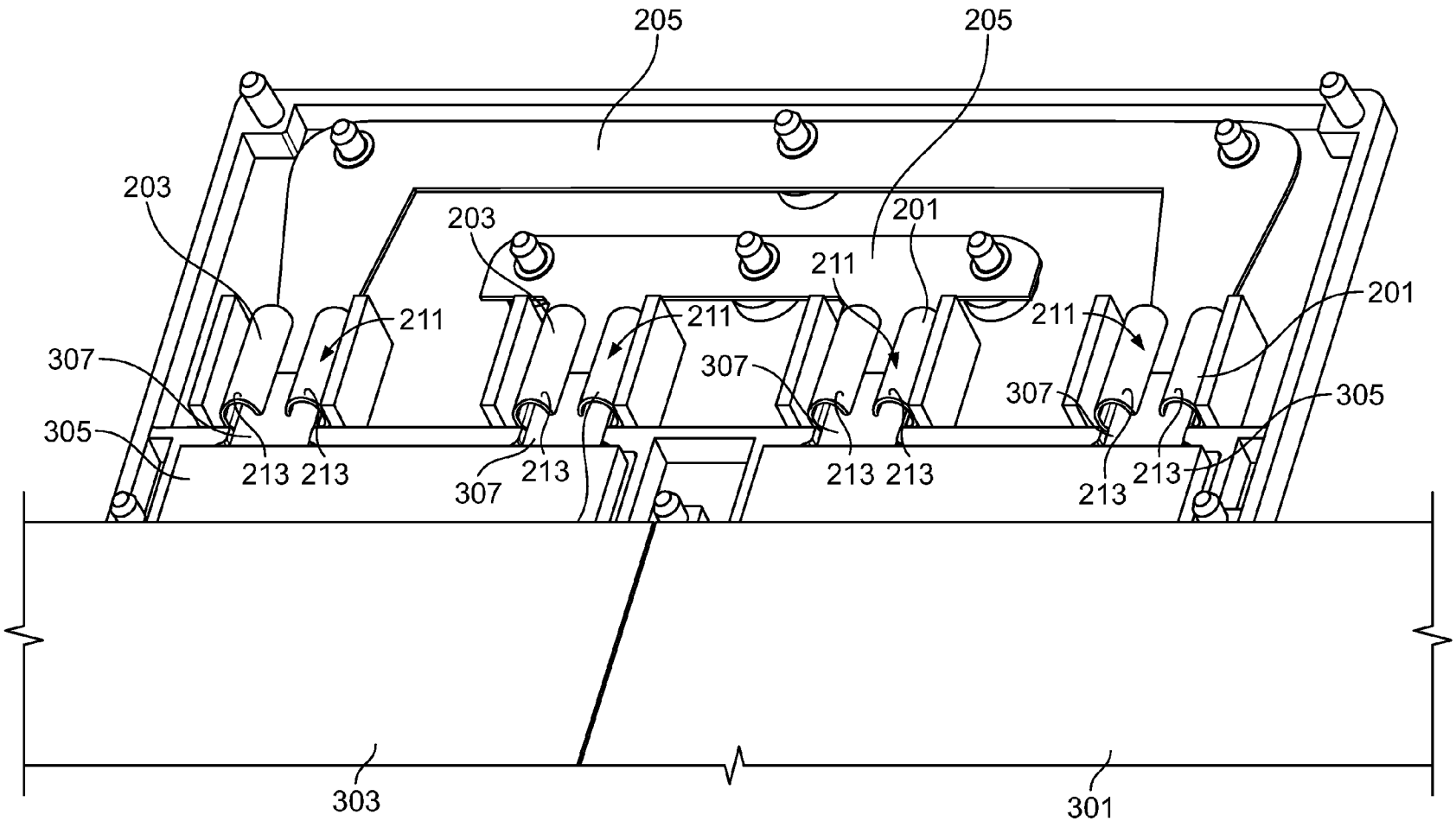
FIG. 3 shows a partially exposed perspective view of an arrangement of a connector and circuits according to an embodiment of the present invention.

As shown in FIG. 1, the connector body 101 and the slots 103 and 105 preferably include a substantially planar arrangement wherein the connector body 101 includes a thickness 111 that is preferably substantially equal to or having minimally greater thickness than circuits 301 connected thereto (see e.g., FIG. 3). The thickness 111 of connector body is selected to provide a low-profile and/or minimal thickness and/or geometry that does not interfere with installation of circuits 301 and may be easily partially or fully concealed from view. In a preferred embodiment, the thickness of the connector body 101 is approximately equal to the thickness of the circuits connected thereto.

Figure 2:
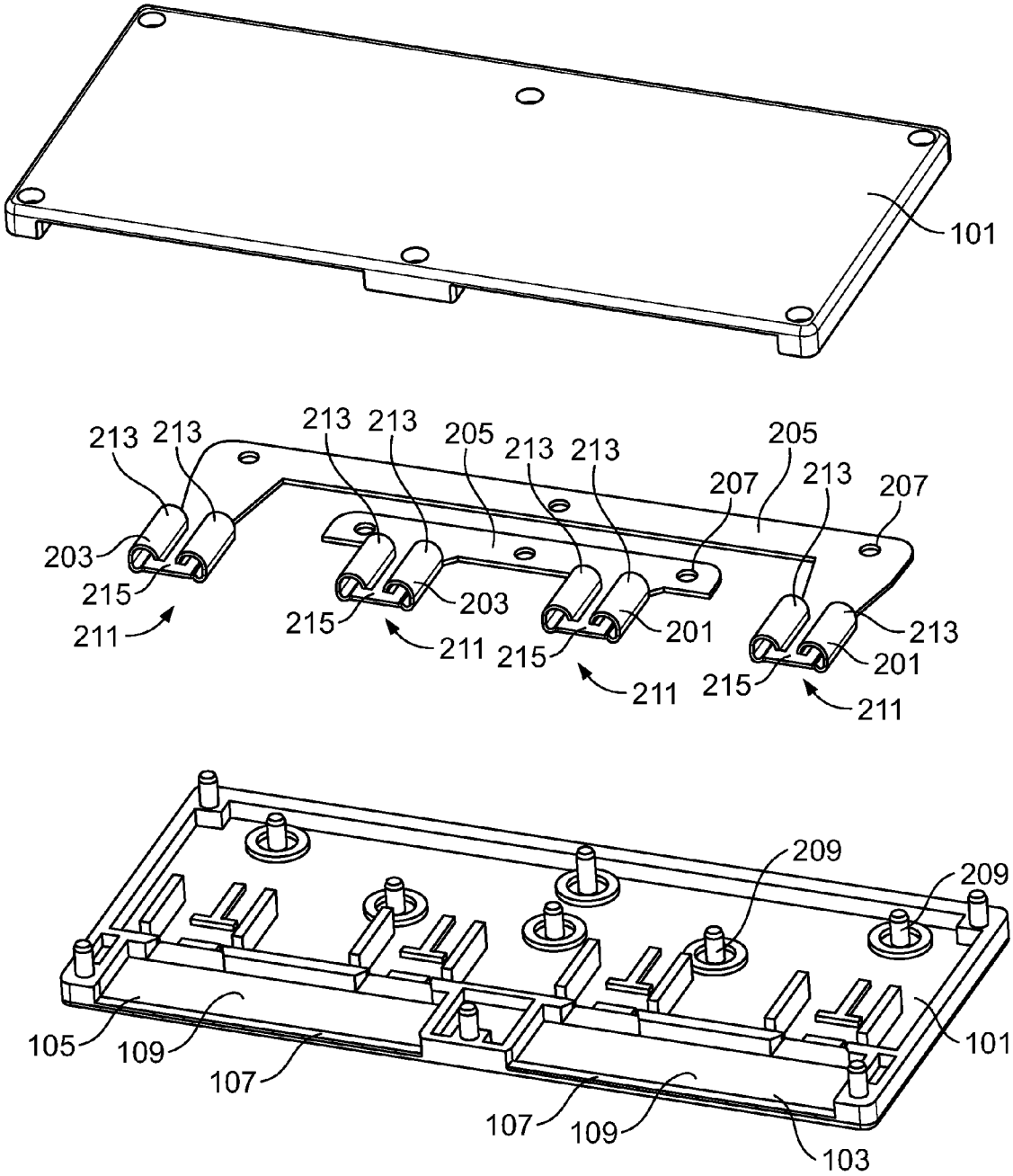
FIG. 2 shows an exploded perspective view of a connector according to an embodiment of the present invention.

FIG. 2 shows an exploded view of the electrical connector 100 of FIG. 1. The connector shown in FIG. 2 includes the connector body 101, first alignment slot 103, second alignment slot 105, tapered surface 107, and surface 109 shown and described above with respect to FIG. 1. In addition, connector 100 includes two bussing interconnections 205. Bussing interconnections, as utilized herein, include electrical connections, such as wiring or other arrangement of conductive material that permit the flow of electricity between two receptacles, which are connectable to a plug or other electrical connection device. The first bussing interconnection 205 includes a first receptacle 201 arranged adjacent first alignment slot 103 and a second receptacle 203 arranged adjacent second alignment slot 105. Likewise, the connector 100 includes a second bussing interconnection 205 that includes a first receptacle 201 arranged adjacent first alignment slot 103 and a second receptacle 203 arranged adjacent second alignment slot 105. As shown in FIG. 2, the bussing interconnections 205 preferably include interconnection features 207 that correspond to connector body features 209 that permit alignment and retention of the bussing interconnection 205 within the connector body 101. The first receptacle 201 and the second receptacle 203 of both bussing interconnections include a receptacle body 211 having a plurality of arms 213 configured to apply a contact force in the direction of an opposing plate 215. The arrangement of the arms 213 allows repeatable insertion and retention of a tabular protrusion 307 (see e.g., FIG. 3) wherein the contact force further provides an electrical connection, when engaged. Likewise, the arms 213 permit release of the tabular protrusion 307 that disengages the tabular protrusion 307 and allows the removal of the tabular protrusion 307. The tabular protrusion 307 may be any tabular structure, including, but not limited to flat wires, connecting tabs and/or plugs.

While at least one of the first receptacle 201 and/or the second receptacle 203 are configured with a plurality of arms 213 configured to apply a contact force in the direction of an opposing plate 215, additional receptacles may be configured with alternate plug arrangements or mechanical connections. For example, the additional receptacle bodies may be configured into clips, plugs, tabs, contact surfaces, or other conventional electrical connection devices. In addition, the bussing interconnection 205 may further include an electrical bridge or other electrical hardware that bridges portions of the bussing interconnection 205 with or without electrical functionality. For example, a diode may be included in bussing interconnection 205 to permit the flow of electricity in a single direction. Any hardware known in the art for providing desirable electrical functionality may be utilized in the bussing interconnection 205.

FIG. 3 shows a perspective view of two circuits 301,303 engaged with connector 100 with a portion of connector body 101 removed. The circuits 301,303 include a plug 305 engaged with slots 103 and 105. The circuits 301, 303 are any suitable configuration of circuitry that requires interconnection and may include electricity generators or electricity loads. In particular, the circuits may include, but are not limited to outdoor or indoor circuits, such as solar cells for use with roofing materials. In addition, the circuits 301,303 may be any circuit that requires a jumper or bus to make an electrical connection either from one device to an adjacent device, or from one circuit to an adjacent circuit. Plug 305 is configured to engage as a corresponding structure with first and second receptacles 201 and 203 and includes tabular protrusions 307 extending from plugs 305. Protrusions 307 engage first and second receptacles 201 and 203, wherein the arms 213 provide a contact force to provide and maintain disengagable electrical contact. The engagement of the circuits 301, 303 permits the electrical connection of a plurality of circuits 301,303 without the need for additional wiring or soldering.

Figure 4:
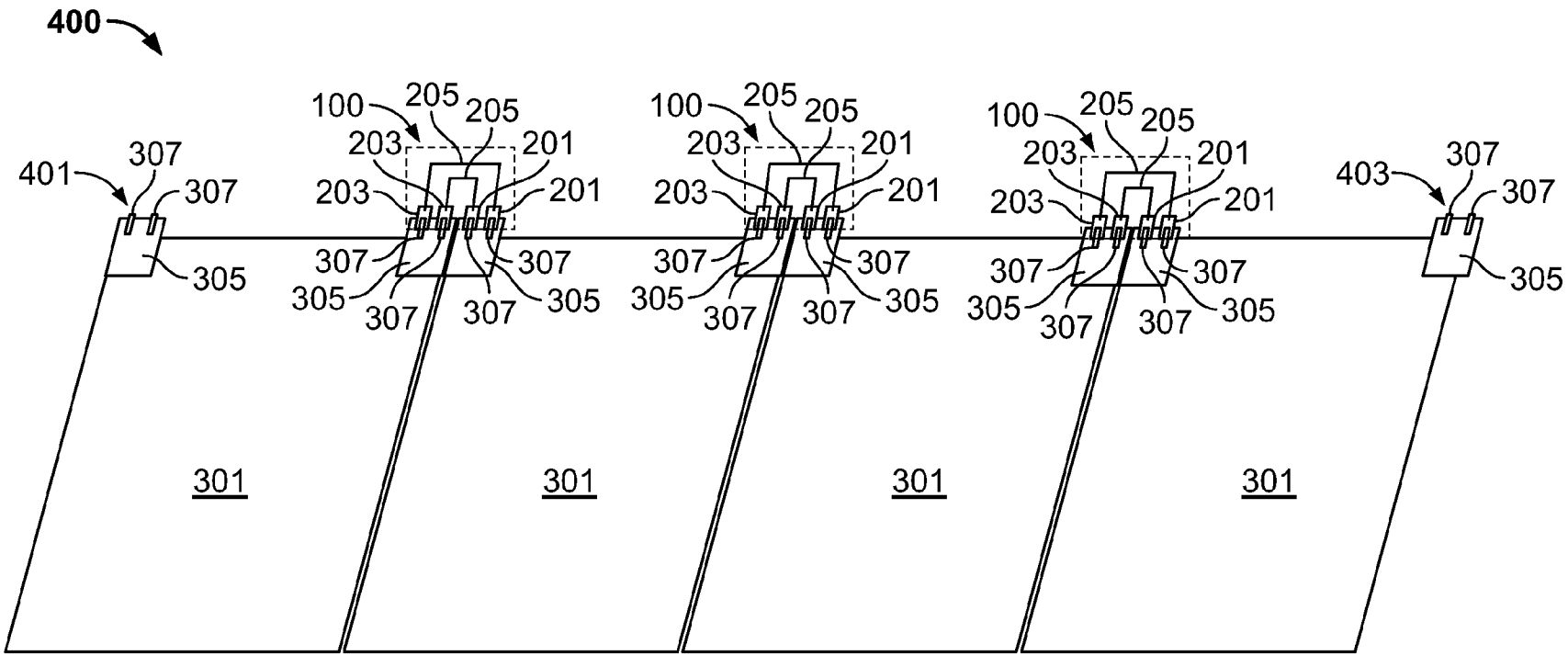
FIG. 4 shows a schematic arrangement of connectors and circuits according to an embodiment of the present invention.

FIG. 4 shows a schematic view of a plurality of circuits 301, according to another embodiment of the invention, connected together with connectors 100 into a circuit bank 400. As shown, the bank 400 includes a plurality of circuits, wherein each of the circuits 301 has two plugs 305, the plugs each having two protrusions 307. The bank 400 further includes a first end 401 and a second end 403, wherein each of the first end 401 and the second end 403 includes two or more protrusions 307 that are connectable to electrical components, such as jumpers, additional connectors 100, electrical loads, circuits or any other electrical device usable with the circuit bank 400. For example, the circuitry may include plugs 305 having a protrusion 307 corresponding to a positive polarity and a protrusion 307 corresponding to a negative polarity, wherein the connection through the connectors 100 is such that a series arrangement of circuits 301 provided. In another embodiment, the first end 401 includes a jumper and the second end 403 is connected to an electrical load. While the above has been described with circuits 301, the present invention may provide electrical connections between any spatially positioned, differing circuits and/or spatially positioned electrical devices.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A low-profile electrical connector comprising a connector body containing a plurality of bussing interconnections wherein each bussing interconnection comprises a first receptacle and a second receptacle, the first receptacle being in electrical communication with the second receptacle;

the connector body comprising an alignment mechanism configured to align and retain a corresponding plug;

wherein at least one of the first receptacle or the second receptacle include a receptacle body having a plurality of arms configured to apply a contact force in the direction of an opposing plate; and wherein the opposing plate of said receptacle and each of the bussing interconnections are in a substantially planar arrangement with each other.

2. The connector of claim 1, wherein the alignment mechanism comprises a tapered slot.

3. The connector of claim 1, further comprising an electrical interconnection between the first bussing connection and the second bussing interconnection.

4. The connector of claim 1, wherein the first bussing interconnection and the second bussing interconnection do not electrically communicate within the connector body.

5. The connector of claim 1, wherein the bussing interconnection further comprises at least one electrical connection device.

6. The connector of claim 5, the electrical connection device independently selected from the group consisting of conductive pads, electrical connectors, plugs, wires, and combinations thereof.

7. An electrical connector system comprising a plurality of low-profile connectors each comprising:

a connector body containing a plurality of bussing interconnections wherein each bussing interconnection comprises a first receptacle and a second receptacle, the first receptacle being in electrical communication with the second receptacle;

the connector body comprising an alignment mechanism configured to align and retain a corresponding plug, at least one of the first receptacle or the second receptacle includes a receptacle body having a plurality of arms configured to apply a contact force in the direction of an opposing plate;

wherein a first receptacle of a first connector body is in contact with a second receptacle of a second connector body, the second receptacle including a second receptacle body having a tabular blade configured for insertion into the first receptacle body to receive the contact force to provide electrical contact and retention of the second receptacle body in position; and wherein the opposing plate of said receptacle and each of the bussing interconnections are in a substantially planar arrangement with each other.

8. The system of claim 7, wherein the alignment mechanism comprises a tapered slot.

9. The system of claim 7, wherein the tabular blade is a flat wire.

10. The system of claim 7, wherein the bussing interconnection further comprises at least one electrical connection device.

11. The system of claim 10, the electrical connection device independently selected from the group consisting of conductive pads, electrical connectors, plugs, wires, and combinations thereof.

* * * * *